US007950189B1

(12) United States Patent
Walker et al.

(10) Patent No.: US 7,950,189 B1
(45) **Date of Patent: *May 31, 2011**

(54) MODULAR IN-WALL MEDICAL SERVICES UNIT

(75) Inventors: James A. Walker, Oklahoma City, OK (US); Taylor C. Culpepper, Oklahoma City, OK (US); Richard J. Webb, Oklahoma City, OK (US); John R. Pierson, Guthrie, OK (US)

(73) Assignee: Modular Services Company, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/814,986

(22) Filed: Jun. 14, 2010

Related U.S. Application Data

(63) Continuation of application No. 10/100,768, filed on Mar. 19, 2002, now Pat. No. 7,775,000.

(51) Int. Cl.
*E04F 19/00* (2006.01)

(52) U.S. Cl. ..... 52/27; 52/220.1; 52/220.7

(58) Field of Classification Search ..... 52/200, 52/220.1, 220.7, 220.5, 28, 36.4, 27; 220/477; 174/503

See application file for complete search history.

(56) References Cited

U.S. PATENT DOCUMENTS 3,620,404 A * 11/1971 Grasso ..... 220/477
4,642,418 A * 2/1987 Menchetti ..... 174/503
7,775,000 B2 * 8/2010 Walker et al. ..... 52/200

* cited by examiner

*Primary Examiner* — Basil Katcheves
(74) *Attorney, Agent, or Firm* — Mary M. Lee

(57) ABSTRACT

A modular in-wall medical services unit for medical care facilities. A frame supports a cabinet with a cover panel providing electrical and/or gas outlets. Built-in electrical and gas conduits are included. A junction box and ends of the gas conduits near the top of the frame are accessible after wallboard is applied. Thus, wallboard can be installed before or after wiring is completed and gas connections are made. The self-aligning cover panel is "floatingly" supported on the frame so that a bead of sealant can be applied around the edge before the cover panel is "snugged up" to the wall and secured. The trim flanges on the cover panel include vertical equipment mounting tracks. Manufacturing is simplified by making the height of the frame adjustable; the same frame elements can be used to assemble units for different ceiling heights, decreasing the number of required parts in inventory and expediting assembly.

10 Claims, 5 Drawing Sheets

MODULAR IN-WALL MEDICAL SERVICES UNIT

This application is a continuation of application Ser. No. 10/100,768, entitled "Modular In-Wall Medical Services Unit," filed Mar. 19, 2002, and the contents of this application is incorporated herein by reference.

FIELD OF THE INVENTION

The present invention relates to devices for providing medical gas and electrical services to hospitals and other medical care facilities.

BACKGROUND OF THE INVENTION

Construction costs for hospitals and other medical care facilities depend in part on the cost of required medical equipment as well as the efficiency of installation of such equipment during the construction phase. One major item installed in most patient care areas is a wall panel for providing medical gases and electrical services at the bedside. Modular assemblies for such panels have simplified installation of these services. Nevertheless, there remains a need to simplify the production and assembly of these units, and to provide greater efficiency in the installation of the units at the construction site. Further, there is a need for modular in-wall type units that provide a more compact, vertically oriented interface for users. Still further, there is a need for a vertically oriented in-wall unit with convenient equipment management capabilities.

SUMMARY OF THE INVENTION

The present invention comprises a modular in-wall medical services unit for installation in the wall of a structure. The structure has at least a first room with a floor and a ceiling level and a wall at least partially defining the first room. The wall comprises a wall space defined at least in part by wallboard. The unit comprises a frame having a first side. The frame is sized to extend from the floor to above the ceiling level of the structure and adapted to be installed in the wall space of the structure.

A first medical service outlet is supported on the frame to be between the floor and the ceiling level of the structure. The first service outlet is positioned to be accessible from the first side of the frame. A first service conduit is supported on the frame to extend from the first service outlet to above the ceiling level of the structure. A first service connection is included. The service connection is operatively connected to the first service conduit and supported on the frame to be above the ceiling level of the structure and to extend from the first side of the frame forward of the wall space into the first room so as to be accessible after installation of the wallboard.

Further, the present invention comprises modular in-wall medical services unit for installation in the wall of any one of a plurality of structures, wherein each of the structures has a first room, a floor and a wall space, and wherein each of the structures has a different ceiling level. The unit comprises a frame having a length adjustable to extend from the floor to above the ceiling level of any of the plurality of structures. The frame is adapted to be installed in the wall space of the structure. A first medical service outlet is supported on the frame to be between the floor and the ceiling level of all of the plurality of structures. The first service outlet is positioned to be accessible from the first side of the frame in the first room.

Still further, the present invention includes a modular in-wall medical services unit for installation in the wall of a structure having a first room defined in part by a wall having a wall space covered by wallboard. The unit comprises a frame adapted to be installed in the wall space of the structure. The frame has a first side for the first room. A first mounting flange is provided on the frame and is adapted to be connected to the edge of wallboard in the first room. A first cover panel is supported on the first side of the frame. A first trim flange on the cover panel, generally parallel to the first mounting flange on the frame, is positioned forwardly of the first mounting flange a distance sufficient to receive wallboard therebetween during installation of the unit.

A first medical service outlet is supported on the first side of the frame to be accessible in the first room through the first cover panel. The first trim flange is movable horizontally relative to the first mounting flange during installation of the wallboard between a first position and a second position. In the first position, the first trim flange is spaced a distance forward of the wallboard between the first mounting flange and the first trim flange. In the second position, the first trim flange engages the wallboard.

Further still, the present invention is directed to modular in-wall medical services unit for installation in the wall of a structure having a first room with a floor and a ceiling level and a wall at least partially defining the first room, wherein the wall comprises a wall space and wallboard forming the wall's exterior surface. This unit comprises a frame having a first side. The frame is adapted to be installed in the wall space of the structure. Also included is a vertically oriented cover panel supported by the frame, the cover panel having a height and a width, the height being greater than the width. The cover panel comprises a pair of vertically-oriented side edges.

A first medical service outlet is supported on the frame and accessible through the cover panel on the first side of the frame from within the first room. A trim flange is provided along at least a portion of at least one of the vertically-oriented side edges of the cover panel. The trim flange is adapted to join the side edge of the cover panel to the wallboard. The trim flange defines a vertically oriented equipment-mounting track therein. The cover panel is positioned on the frame so that when the frame is installed in the wall space, the first service outlet and the equipment-mounting track are positioned to be used conveniently by a human operator standing in the first room.

Finally, the present invention comprises a modular in-wall medical services unit for installation in the wall of a structure having a first room with a floor and a ceiling level and a wall at least partially defining the first room, the wall comprising a wall space. The unit comprises a frame having a first side. The frame is adapted to be installed in the wall space of the structure. The frame supports a vertically oriented cover panel. The cover panel has a height and a width, the height being greater than the width. The height of the cover panel is less than the distance between the floor and the ceiling level of the first room.

A first medical service outlet is supported on the frame and accessible through the cover panel on the first side of the frame from within the first room. The cover panel is positioned on the frame so that when the frame is installed in the wall space, the first medical service outlet is positioned to be conveniently used by a human operator standing in the first room.

DETAILED DESCRIPTION OF THE PREFERRED EMBODIMENT

Figure 1:
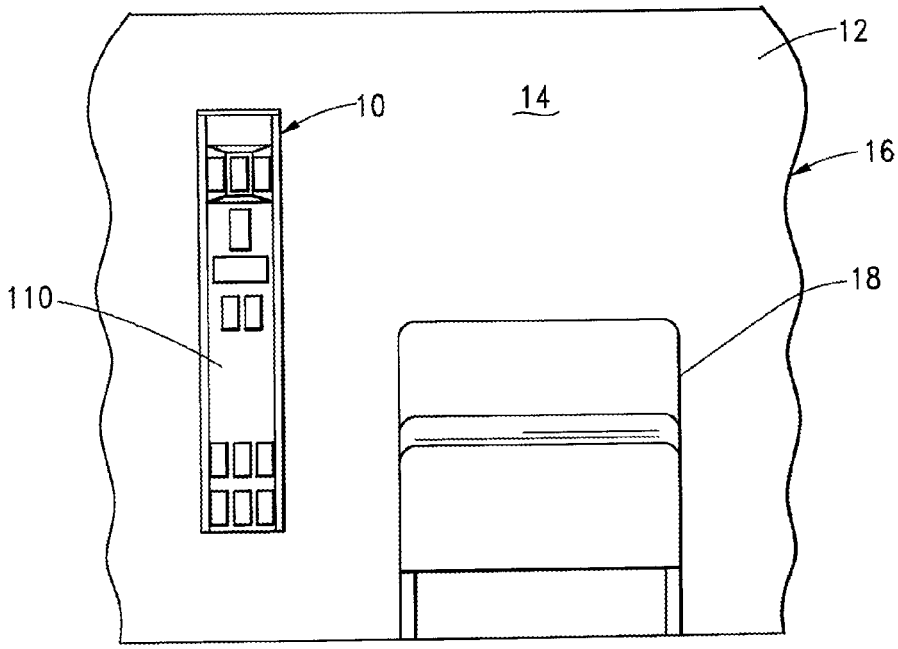
FIG. 1 is an elevational, fragmented view of hospital room showing the modular medical services unit of the present invention installed in the wall near a bed.

Turning now to the drawings in general and to FIG. 1 in particular, there is shown therein a modular medical services unit constructed in accordance with the present invention and designated generally by the reference numeral 10. As used herein, "medical service" or "service" refers to any one of a variety of gas, electrical or communication services, including but not limited to oxygen, compressed air, vacuum (suction), electricity, telephone and video cable. The unit 10 is illustrated installed in the wall 12 of at least a first room 14 in a structure 16. Usually, the unit 10 will be installed at the side of a patient bed 18. While a conventional hospital room is depicted, the unit 10 may be installed in a variety of structures such as clinics, emergency rooms, nursing home rooms, and virtually any sort of treatment facility.

Figure 2:
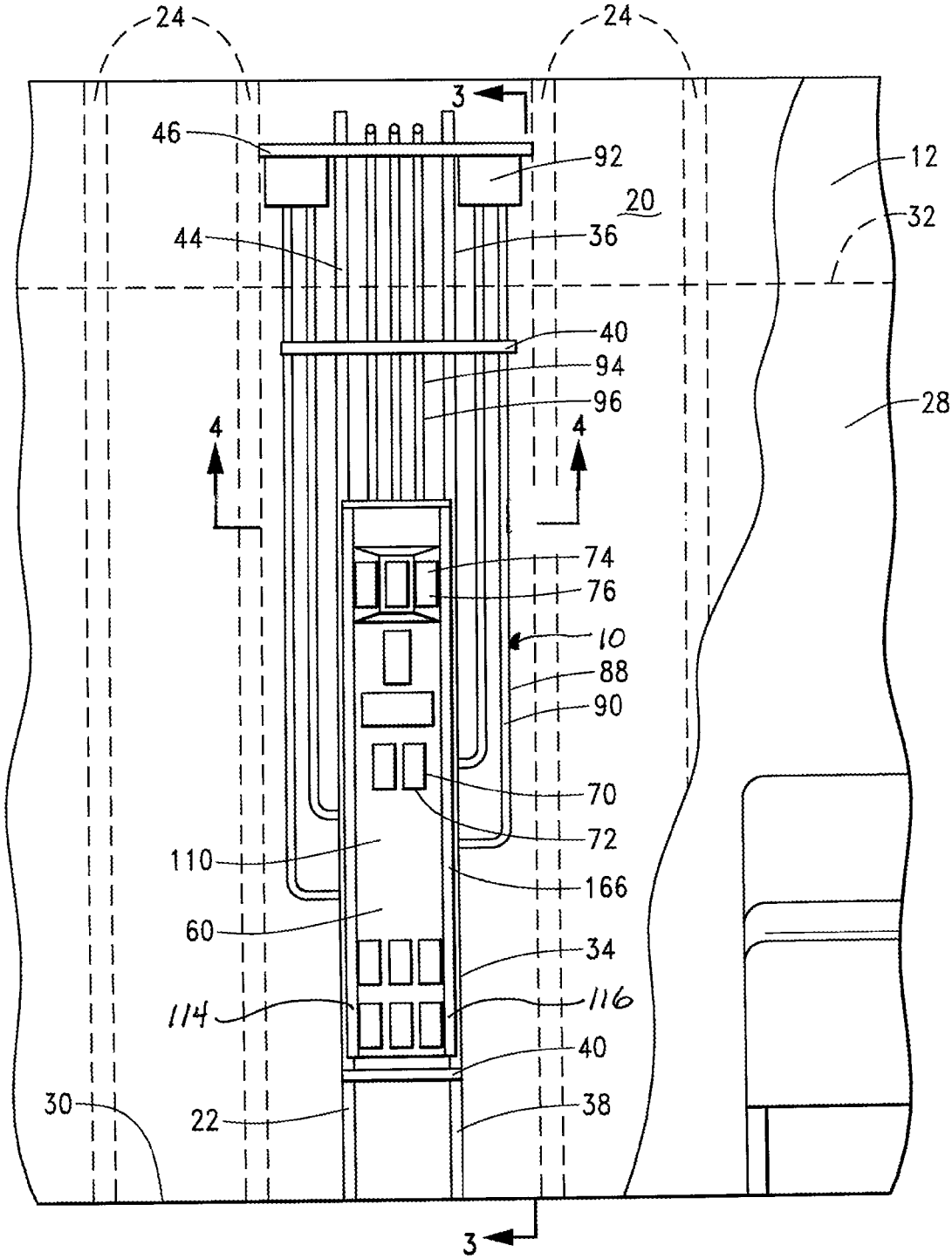
FIG. 2 is an elevational, fragmented view of the hospital room shown in FIG. 1 with the wallboard cut away to reveal the installation of the unit between the wall studs of the wall space.
Figure 3A:
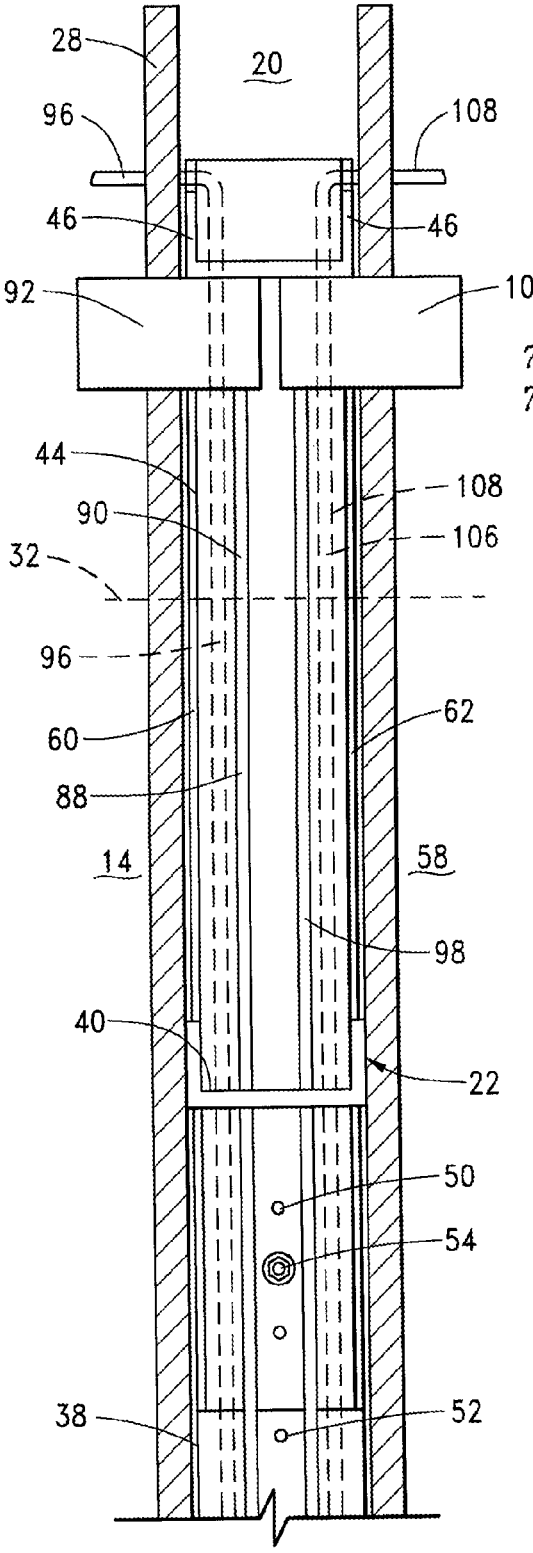
FIGS. 3A and 3B are a longitudinal sectional view taken along line 3-3 of FIG. 2.
Figure 3B:
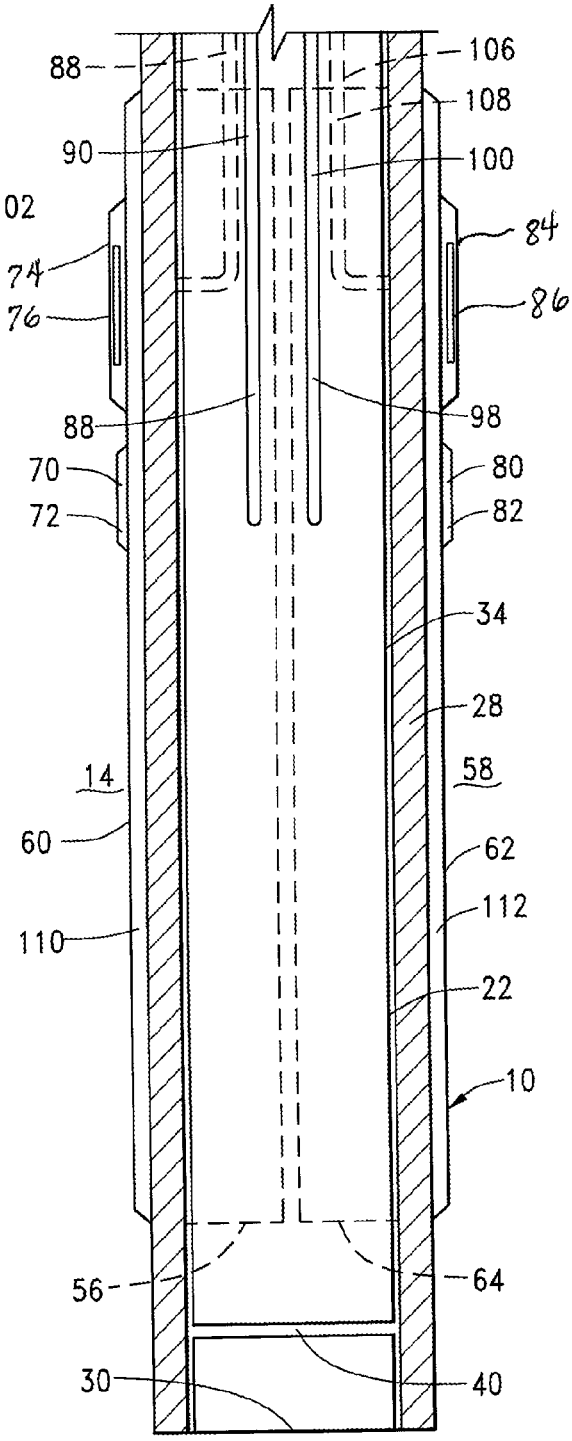

As shown in FIGS. 2 and 3A-3B, the unit 10 is adapted for installation in the wall space 20 defining the first room 14. Preferably, the unit comprises a frame 22 sized to be installed between wall studs 24 in the wall space 20 defined by wallboard 28. More preferably, the frame 22 is sized to extend from the floor 30 to a distance above the ceiling level 32 of the room 14.

In the preferred embodiment, the frame 22 comprises a main frame assembly 34 and a top frame assembly 36. The main frame assembly 34 preferably comprises a pair of C-shaped vertical rails 38 stabilized by one or more cross rails 40 (FIGS. 2, 3B). Similarly, the top frame assembly 36 is shorter in length but formed of a pair of opposing C-shaped vertical rails 44 and at least one stabilizing cross rail 46 (FIGS. 2, 3A).

The vertical rails 38 and 44 may be formed from sheet metal having a thickness sufficient to provide the necessary rigidity to the unit 10. For example, in a preferred construction, the metal of which the rails are made may be only about 1/16 inch. Conventional wallboard typically has a thickness of about 5/8 inch. However, for clarity of illustration, the thickness of the metal in the vertical rails 38 and 44, as shown in FIGS. 3A and 3B is exaggerated relative to the thickness of the wallboard.

As best seen in FIGS. 3A-3B, the corresponding C-shaped rails 38 and 44 of the main frame assembly 34 and the top frame assembly 36 may be telescopically engaged so that the overall height or length of the frame 22 can be adjusted. To that end, a plurality of vertically arranged holes 50 and 52 are provided in the vertical rails 38 and 44, respectively. A bolt 54 or fastener of some sort may be used to secure the vertical rails 38 and 44 at the desired length.

At least a first cabinet 56 is supported in the frame 22, preferably in the main frame assembly 34 between the vertical rails 38. When the unit 10 is to be used in a wall space shared by a second room 58, the unit may be functional on both first and second sides 60 and 62, as seen in FIGS. 3A and 3B. Thus, a second cabinet 64 may be supported in the frame 22 back-to-back with the first cabinet 56.

The first cabinet 56 preferably provides a divided enclosure to house the medical service outlets. The service outlets preferably include a first plurality of electrical outlets designated generally at 70, including at least first electrical outlet 72, and a first plurality of gas outlets designated generally at 74, including at least a first gas outlet 76 on the first side 60 of the frame 22. Similarly, the second cabinet 64 preferably provides a divided enclosure to house medical service outlets. More preferably, the service outlets in the second cabinet 64 comprise a second plurality of electrical outlets designated generally at 80, including at least a second electrical outlet 82, and a second plurality of gas outlets designated generally at 84, including at least a second gas outlet 86 on the second side 62 of the frame 22. Thus, the gas and electrical outlets and other service outlets are supported on the frame to be positioned between the floor 30 and the ceiling level 32 of the structure 16 and accessible from the first and second sides 60 and 62 of the frame 22 when the unit 10 is installed.

Referring still to FIGS. 2 and 3A-3B, the unit 10 also preferably includes medical service conduits, such as a first plurality of electrical conduits designated generally at 88 including at least a first electrical conduit 90 supported on the frame 22. The conduits 88 extend from the first electrical outlet 72 up through the main frame assembly 34 to a point in the top frame assembly 36 above the designated ceiling level 32. As used herein, "electrical conduit" denotes generally the tubular conduit and the wires contained in it.

Also included in the unit is at least one medical service connection for each medical service conduit. For example, in the preferred unit 10, the service connections include at least a first electrical junction box 92 preferably supported in the top frame assembly 36 and positioned to be above the ceiling level 32 and to extend from the first side 60 of the frame 22 forward of the wall space 20 into the first room 14 (not shown in FIG. 2). In this way, the electrical service connection will be accessible before and after the wallboard 28 is installed. The junction box 92 is operatively connected to at least the first electrical conduit 90.

The service conduits may include gas conduits in addition to electrical conduits. To that end, the unit 10 preferably also comprises at least a first plurality of gas conduits 94 including a first gas conduit 96 supported on the frame 22 to extend from the first gas outlet 76 to a point above the ceiling level 32 of the top frame assembly 36. The upper end of the gas conduit 96 preferably is bent outwardly or provided with an elbow fitting to provide a gas service connection forward a distance of the wall space 20 once the unit 10 is installed. In this way, the gas connection will also be accessible before and after the wallboard 28 is installed.

As seen in FIGS. 3A and 3B, the unit 10 may also include a second plurality of electrical conduits designated generally at 98 including at least a second electrical conduit 100 extending from the second electrical outlet 82 on the second side 62 of the frame 22 up through the main frame assembly 34 to a point in the top frame assembly 36 above the designated ceiling level 32. At least a second junction box 102 may be supported in the top frame assembly 36 back-to-back with the first junction box 92, also positioned to be above the ceiling level 32 and to extend from the second side 62 of the frame 22 forward of the wall space 20 into the second room 58. Alternately, a single junction box may be utilized, in which case all the electrical conduits will be connected to the single junction box.

As shown in FIG. 1, a part of the unit 10 remains exposed when fully installed in the first room 14. This part preferably comprises a cover panel that supports the faces of the various electrical and gas service outlets. More preferably, the cover panel is vertically oriented, that is, it is taller than it is wide, or has a height greater than its width. Most preferably, the cover panel is positioned on the frame 22 so that when the frame is installed in the wall space 20, the medical service outlets are located for convenient use by a human operator standing in the first room 14.

A first cover panel 110 covers the first cabinet 56 on the first side 60 of the frame 22. Likewise, as seen in FIG. 3B, a second cover panel 112 covers the second cabinet 64 on the second side 62 of the frame 22.

The dual-sided unit 10 further preferably includes a second plurality of gas conduits 106 including a second gas conduit 108. The second plurality of gas conduits 106 and the second gas conduit 108, as on the first side 60, are supported on the second side 62 of the frame 22 to extend from the second plurality of gas outlets 84 and the second gas outlet 86, respectively, to above the ceiling level 32 of the structure 16.

The preferred installation of the unit 10 provides for the wallboard 28 to be cut to fit closely around and behind the vertically oriented side edges 114 and 116 (FIG. 2) of the cover panels 110 and 112. For that purpose, a trim and flange combination is provided to provide a secure installation and an attractive façade for the unit 10. A detailed description of this trim and flange assembly will be made with reference to FIGS. 4 and 5, to which attention now is directed.

Figure 4:
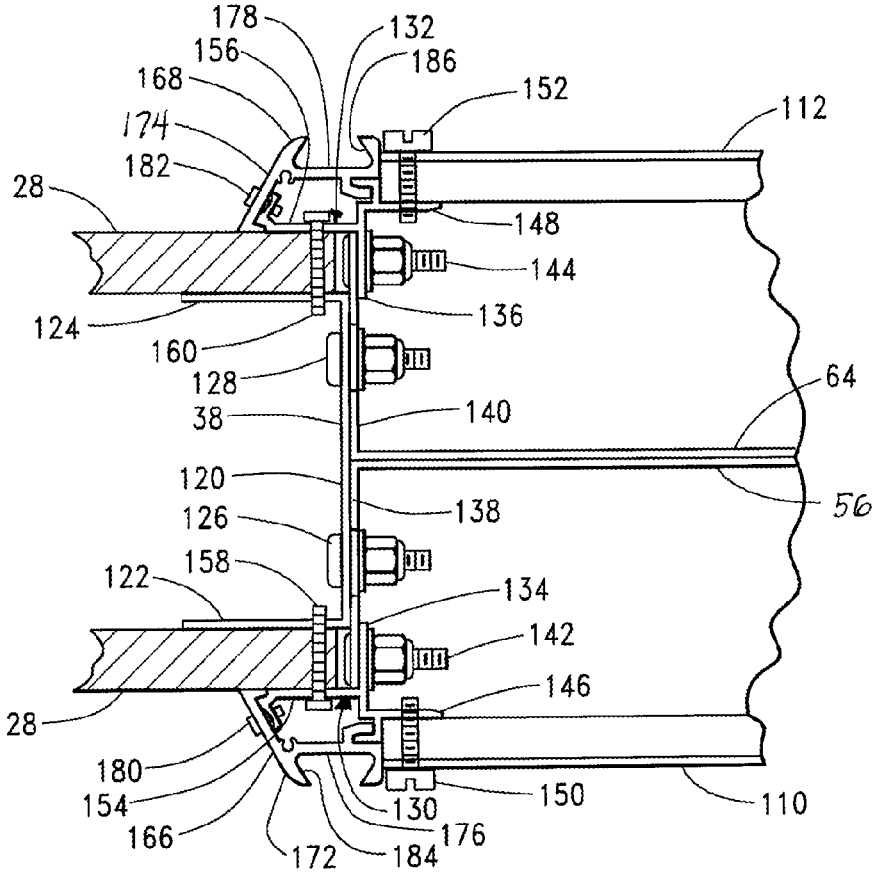
FIG. 4 is a fragmented, cross sectional view taken along line 4-4 of FIG. 2. The service outlets have been omitted for clarity of illustration.
Figure 5:
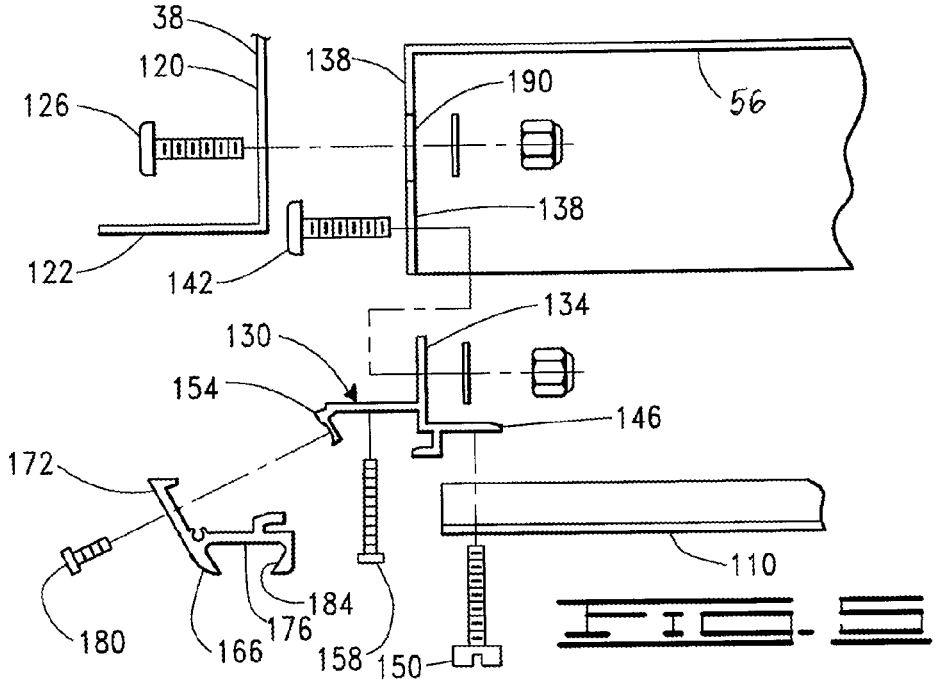
FIG. 5 is a fragmented, exploded cross sectional view of a portion of the cross section of the unit shown in FIG. 4.

FIG. 4 is a fragmented cross-sectional view taken through one end (the left end as viewed in FIG. 2) of the main frame assembly 34 of the unit 10. FIG. 5 is an exploded view of one corner of the end shown in FIG. 4. The outlet assemblies have been omitted to clarify the illustrations.

The left vertical rail 38 comprises a planar central portion 120 arranged to be positioned generally transverse to the wall space 20. Extending laterally from the central portion 120 are first and second opposing mounting flanges 122 and 124 positioned to be generally co-planar with the wallboard 28 to be applied.

The depth of the frame 22, that is, the width of the central portion 120 is selected to conform to the depth of the wall space 20. In this way, when fixed in position between the wall studs 24 (see FIG. 2), the central portions 120 of the rails 38 (and the corresponding central portions of the rails 44 in the top frame assembly 36) can be used conveniently to attach the frame 22 to adjacent studs 24. The flanges 122 and 124 provide elongated vertical mounting flanges positioned to abut and support the interior side of the wallboard 28 around the cover panels 110 and 112 (FIG. 3B).

The first and second cabinets 56 and 64 are slidably attached to the central portion 120 and the vertical rail 38 by the bolts 126 and 128 to in a manner to be described hereafter. Trim flanges 130 and 132 are extruded edge members attached to the vertical sides of the cabinets 56 and 64. While this attachment can be accomplished in various ways, in the present embodiment, the trim flanges 130 and 132 include inward extensions 134 and 136 that extend inwardly to overlap the sidewalls 138 and 140 of the cabinets 56 and 64 and attached thereto by bolts 142 and 144.

The trim flanges 130 and 132 further preferably comprise extensions 146 and 148 to underlay the edges of the cover panels 110 and 112. Bolts 150 and 152 attach the extensions 146 and 148 to the cover panels 110 and 112. The trim flanges 130 and 132 include legs 154 and 156. The legs 154 and 156 are configured to be generally parallel to but spaced a distance forward of the mounting flanges 122 and 124. Bolts 158 and 160 are included to extend through the legs 154 and 156 and mounting flanges 122 and 124 and the wallboard 28 sandwiched therebetween.

With continuing reference to FIGS. 4 and 5, vertical cover strips 166 and 168 preferably are provided to cover the trim flanges 130 and 132 and the bolts 158 and 160. Like the trim flanges 130 and 132, the cover strips 166 and 168 preferably are extrusions. More preferably, the cover strips 166 and 168 comprise angled strips having side portions 172 and 174 and front portions 176 and 178. The side portions 172 and 174 provide sections to receive small screws 180 and 182 to attach the cover strips 166 and 168 to the trim flange legs 154 and 156.

Equipment mounting tracks 184 and 186 conveniently may be provided in the front portions 176 and 178 of the cover strips 166 and 168. More preferably, the tracks 184 and 186 are integrally formed in the extruded strips 166 and 168. Thus, in addition to the other advantages of the unit of the present invention, the trim flanges 130 and 132 of the cover panels 110 and 112 include the convenience of built-in equipment management. Moreover, like the medical service outlets also contained in the cover panels 110 and 112, these mounting tracks will be conveniently accessible by a human operator standing in the first room 14.

Figure 6:
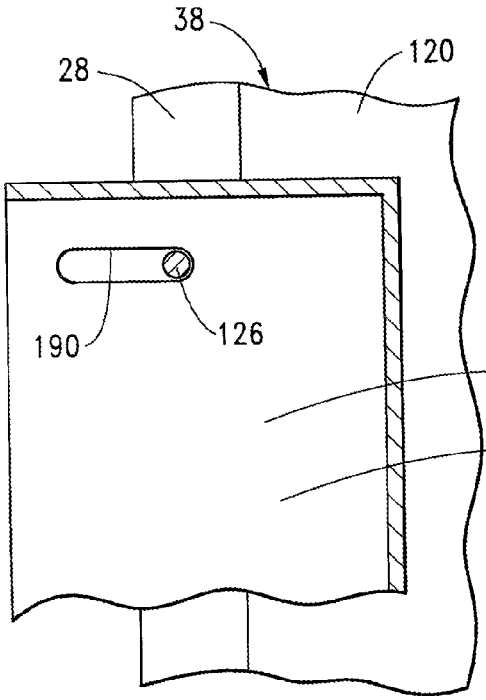
FIGS. 6 and 7 are fragmented longitudinal sectional views taken through a portion of the unit through the cabinet illustrating how the cabinet is slidably mounted to move forward and rearward in the main frame of the unit.
Figure 7:
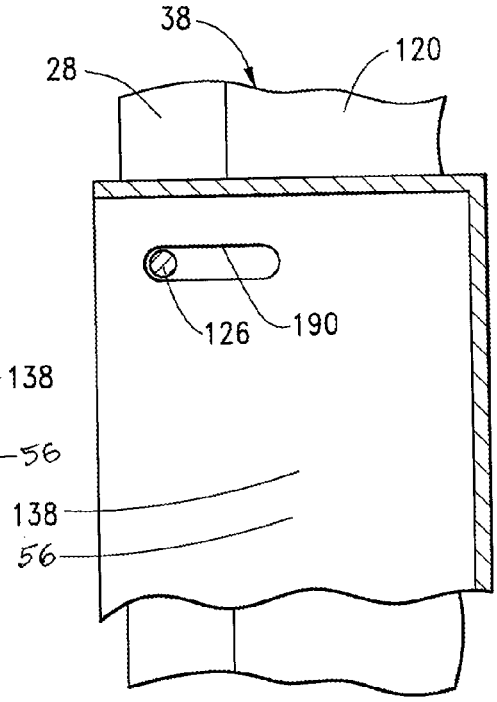

The sliding or moving connection between the cabinet/cover panel/trim flange assembly relative to the frame 22 is shown in more detail in FIGS. 6 and 7. While other types of connections are suitable, in the present embodiment the movable connection comprises an elongated horizontal slot 190 formed in the sidewall 138 of the cabinet 56 to receive the bolt 126. (See also FIG. 5.) The allows the cabinet 56 to be moved forwardly and rearwardly, or horizontally relative to the frame 22, between a first and second position.

Figure 8:
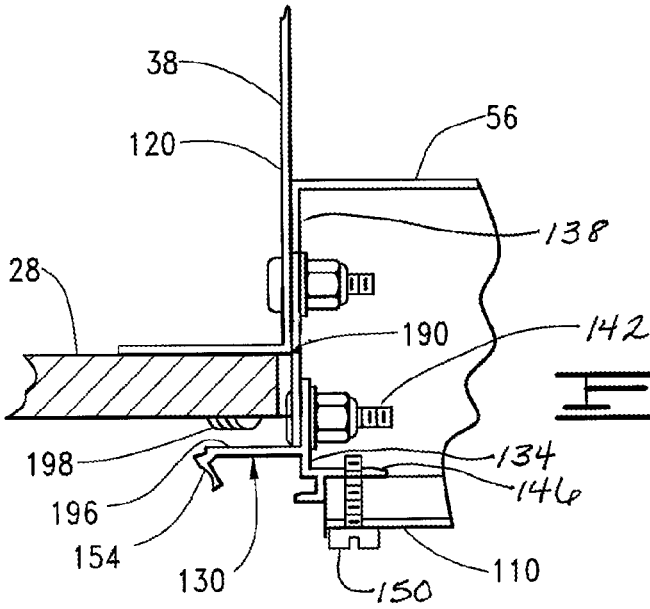
FIGS. 8-10 illustrate the steps employed to install the wallboard around the unit and attach the trim flange along the exposed edges of the unit.
Figure 9:
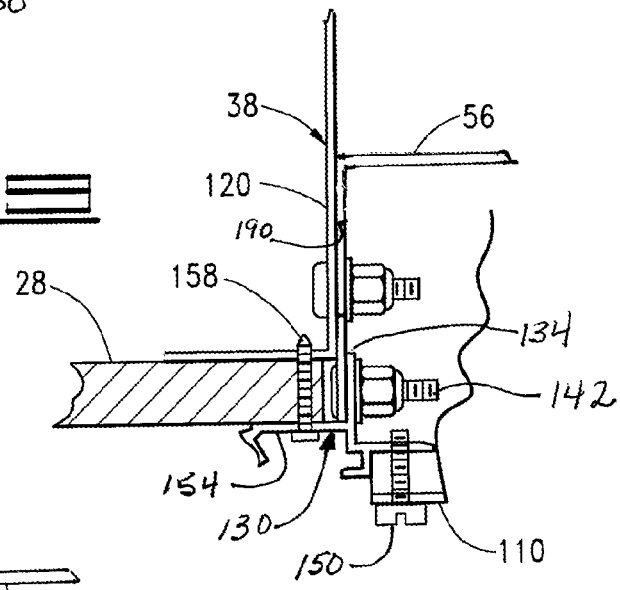
Figure 10:
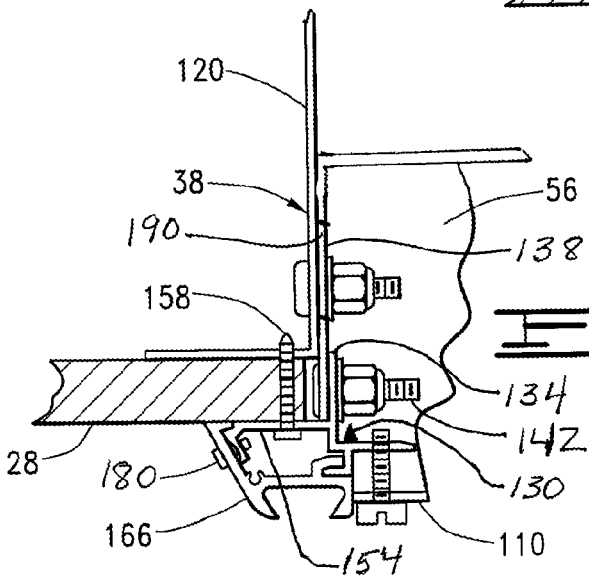

The advantage of the movable connection shown in FIGS. 6 and 7 is illustrated in FIGS. 8-10. In FIG. 8, the cabinet 56 and attached cover panel 110 are pulled forward to the first position to provide a space 196 between the leg 154 of the trim flange 130 and the surface of the wallboard 28. In this position, it is easy to run a bead of sealant 198 in the space 196. Next, as seen in FIG. 9, the cabinet 56 and attached cover panel 110 are pushed back to the second position forcing the trim flange 130 against the face of the wallboard 28 to engage the wallboard. The bolt 158 then is installed. FIG. 10 illustrates the attachment of the cover strip 166 with the attachment screw 180.

Having described the construction of the unit, the use will be summarized. The unit, as delivered to the construction site, preferably has the cabinets mounted inside the frame. The cabinets, conduits and junction boxes are secured to the frame. The height of the frame will have been adjusted at the factory to accommodate the specified ceiling level of the room into which the unit is to be installed. The cover panels are secured over the front of the cabinets with the trim flanges on the long vertical edges between the cover panels and the cabinets. The cabinet and attached cover panels will be slightly movable or "floating" on the frame, and the cover strips will be separate or separable from the trim flanges.

After unpacking the unit, the unit will be placed in the wall space between two studs, and the vertical rails of the frame are secured to the partition system. Next, the cabinet/cover panel assembly is pulled to its outward most position and the wallboard is installed. The wallboard may be installed around the cover panel and all the way up to deck above the ceiling level. That is, the wallboard may be installed over the top frame assembly of the unit, leaving the service connections, such as the junction boxes and the ends of the gas conduits accessible.

Once the wallboard is installed, there is still a space between the face of the wallboard and the trim flange around the cover panel. If desired, a bead of caulk or sealant is applied. Next, the cover panel is pushed back against the wallboard, forming a seal between the edge of the wallboard, the trim flange and the sealant therebetween. Now it will be seen that the floating connection allows the cabinet assembly to be self-aligning; it will meet the wall surface closely from top to bottom regardless of irregularities in the wallboard surface of lack of plumb in the wall studs.

Next, screws are inserted through the trim flange, through the wallboard and into the mounting flange of the frame behind it, to hold the wallboard securely between the cover panel in front and the mounting flange of the frame behind it. Finally, the cover strips may be attached over the trim flanges and end caps may be attached at the bottom and top edges of the cover panel for a finished appearance.

Now it will be appreciated that the modular medical services unit of the present invention provides several advantages at both the manufacturing level as well as at the point of installation. The frame is constructed of two rail assemblies joined by an easily adjustable telescoping arrangement. These main structural components can be manufactured and kept in inventory. Upon receipt of an order specifying a specific ceiling level, the unit can be assembled quickly and adjusted to the appropriate length. The length is selected so that the attached gas conduits and junction boxes will be above the ceiling level. The elbow connections on the gas conduits extend the connections out into the space forward of the wallboard. Likewise the junction boxes are positioned forward on the frame so that the front closure on the boxes can be accessed even after the wallboard is installed. Thus, there is no need for the installation of the wallboard to be delayed until the electrical work or piping can be completed.

A further advantage of the unit of this invention is found in the manner in the way the cover panel is attached to the unit. When delivered to the construction site, the trim flange on the cover panel, and typically the entire cover panel, is movably attached to the frame or cabinet providing a self-aligning feature during installation. This floating connection allows the cover panel to be pulled out slightly to apply a bead of caulk or sealant around the opening in the wallboard before the cover panel is fully secured to the wallboard and frame. A further advantage is found in the vertical equipment mounting tracks provided in the vertical cover strips.

Changes can be made in the combination and arrangement of the various parts and steps described herein without departing from the spirit and scope of the invention.

What is claimed is:

1. A modular in-wall medical services unit for installation in the wall of a structure having a first room defined in part by a wall having a wall space covered by wallboard having a thickness, the unit comprising:

a frame adapted to be installed in the wall space of the structure, the frame having a first side for the first room;

a first mounting flange on the frame connectable to the edge of the wallboard in the first room when the wallboard is installed;

a first cover panel supported on the first side of the frame;

a first trim flange on the cover panel generally parallel to the first mounting flange on the frame, wherein the first trim flange is positioned forwardly of the first mounting flange a distance sufficient to receive wallboard therebetween during installation of the unit;

a first medical service outlet supported on the first side of the frame to be accessible in the first room through the thickness of the first cover panel;

wherein the first trim flange is movable slidably, bidirectionally and horizontally relative to the first mounting flange during installation of the wallboard between a first position and a second position, wherein in the first position the first trim flange is spaced a distance forward of the mounting flange that is greater than the thickness of the wallboard, and wherein in the second position the first trim flange is spaced a distance from the mounting flange that will allow the trim flange and the mounting to engage the wallboard when the wallboard is installed between the mounting flange and the trim flange.

2. The modular medical services unit of claim 1 including means for securing the first trim flange and first mounting flange and the wallboard therebetween.

3. The modular medical services unit of claim 2 further comprising a first cover strip sized to be attached over the first trim flange after installation of the unit.

4. The modular medical services unit of claim 3 wherein the first cover strip defines a vertical equipment mounting track.

5. The modular medical services unit of claim 1 further comprising a first cabinet supported on the first side of the frame for containing the first service outlet.

6. The modular medical services unit of claim 1 wherein the structure includes a second room and the frame has a second side for the second room, and wherein the unit further comprises:

a second mounting flange on the frame adapted to support the edge of wallboard in the second room;

a second cover panel supported on the second side of the frame;

a second trim flange on the cover panel generally parallel to the second mounting flange on the frame, wherein the second trim flange is positioned forwardly of the second mounting flange a distance sufficient to receive wallboard therebetween during installation of the unit;

a second service outlet supported on the second side of the frame to be accessible in the second room through the second cover panel;

wherein the second trim flange is movable horizontally relative to the second mounting flange during installation of the wallboard between a first position and a second position, wherein in the first position the second trim flange is spaced a distance forward of the wallboard between the second mounting flange and the second trim flange, and wherein in the second position the second trim flange engages the wallboard.

7. The modular medical services unit of claim 6 including means for securing the second trim flange and second mounting flange and the wallboard therebetween.

8. The modular medical services unit of claim 7 further comprising a second cover strip sized to be attached over the second trim flange after installation of the unit.

9. The modular medical services unit of claim 8 wherein the second cover strip defines a vertical equipment mounting track.

10. The modular medical services unit of claim 9 further comprising a second cabinet supported on the second side of the frame for containing the second service outlet.

* * * * *